US009922556B2

(12) United States Patent
Peri et al.

(10) Patent No.: US 9,922,556 B2
(45) Date of Patent: Mar. 20, 2018

(54) TRAFFIC LIGHT SYSTEM AND METHOD

(71) Applicant: Intellicon Ltd., Zichron Yaakov (IL)

(72) Inventors: Natan Peri, Zichron Yaakov (IL); Itai Peri, Zichron Yaakov (IL)

(73) Assignee: Intellicon Ltd., Zichron Yaakov (IL)

( * ) Notice: Subject to any disclaimer, the term of this patent is extended or adjusted under 35 U.S.C. 154(b) by 266 days.

(21) Appl. No.: 14/771,946

(22) PCT Filed: Mar. 3, 2014

(86) PCT No.: PCT/IL2014/050209

§ 371 (c)(1),
(2) Date: Sep. 1, 2015

(87) PCT Pub. No.: WO2014/136104

PCT Pub. Date: Sep. 12, 2014

(65) Prior Publication Data

US 2016/0019784 A1 Jan. 21, 2016

Related U.S. Application Data

(60) Provisional application No. 61/772,063, filed on Mar. 4, 2013.

(51) Int. Cl.

| | |
|---|---|
| ***G08G 1/08*** | (2006.01) |
| ***G08G 1/095*** | (2006.01) |
| ***G08G 1/017*** | (2006.01) |

(52) U.S. Cl.

CPC ..... *G08G 1/08* (2013.01); *G08G 1/017* (2013.01); *G08G 1/095* (2013.01)

(58) Field of Classification Search

CPC ..... G08G 1/08; G08G 1/083; G08G 1/095; G08G 1/017

(Continued)

(56) References Cited

U.S. PATENT DOCUMENTS

| | | | |
|---|---|---|---|
| 7,557,731 | B2 | 7/2009 | Ramasubbu |
| 2002/0145541 | A1 | 10/2002 | Matsui et al. |

(Continued)

FOREIGN PATENT DOCUMENTS

| | | | |
|---|---|---|---|
| JP | H07-262488 | A | 10/1995 |
| JP | 2004-013199 | A | 1/2004 |

(Continued)

OTHER PUBLICATIONS

Patent Cooperation Treaty, International Search Report, International Patent Application No. PCT/IL2014/050209, dated Jun. 26, 2014, 4 Pages.

(Continued)

*Primary Examiner* — Brian Wilson
(74) *Attorney, Agent, or Firm* — Fenwick & West LLP

(57) ABSTRACT

The present invention is a system and method for dynamically and accurately allocating green light time of a traffic light at a given intersection by counting the number of vehicles located in an approach to a given intersection. A signal controller radio transceiver of a stationary intersection mounted control unit (CU) receives identifying signals transmitted by the on board vehicle radio transceiver of vehicles located at an approach to this intersection. A signal controller interface processing unit of the CU at the given intersection is operable to disregard signals transmitted by vehicles located at one or more upstream intersections and by pedestrians and passengers of a common motor vehicle. The number of vehicles located at an approach is thereby counted, allowing the CU to dynamically allocate green light time of a corresponding traffic light in accordance with traffic arrangement, for example per approach or per signal group, and design preferences.

17 Claims, 9 Drawing Sheets

(58) Field of Classification Search
USPC ..... 340/907–932
See application file for complete search history.

(56) References Cited

U.S. PATENT DOCUMENTS

| | | | | |
|---|---|---|---|---|
| 2006/0202862 | A1 | 9/2006 | Ratnakar | |
| 2008/0150759 | A1 | 6/2008 | Ramasubbu | |
| 2009/0231160 | A1 | 9/2009 | Ramasubbu | |
| 2013/0069799 | A1* | 3/2013 | Ma | G08G 1/07 340/907 |

FOREIGN PATENT DOCUMENTS

| | | | |
|---|---|---|---|
| JP | 2004-287983 | A | 10/2004 |
| JP | 2005-352615 | A | 12/2005 |
| JP | 2008-102738 | A | 5/2008 |
| JP | 2012-8752 | A | 1/2012 |
| KR | 2004-0022306 | A | 3/2004 |

OTHER PUBLICATIONS

Patent Cooperation Treaty, Written Opinion of the International Searching Authority, International Patent Application No. PCT/IL2014/050209, dated Jun. 26, 2014, 5 Pages.
Patent Cooperation Treaty, International Preliminary Report on Patentability, dated Jun. 14, 2015, 20 pages.

* cited by examiner

Stage 4 – allocating green light time to a signal group

TRAFFIC LIGHT SYSTEM AND METHOD

FIELD OF THE INVENTION

The present invention relates to the field of traffic control systems. More particularly, the invention relates to a system and method for dynamically allocating green light time of a traffic light at a given intersection.

BACKGROUND OF THE INVENTION

Many prior art systems are known for dynamically allocating green light time of a traffic light for enabling free passage of a vehicle through a given intersection.

For example, U.S. Pat. No. 7,557,731 discloses a system and method for regulating the flow of traffic at a roadway intersection having one or more traffic signals by positioning a processor in the vicinity of the intersection to store cycle times of the traffic flow directions, mounting an RFID reader in the vicinity of each traffic signal in communication with the processor, mounting a plurality of RFID tags in the vicinity of a license plate so as to be within the communication range of an RFID reader at the intersection and so that the RFID readers interrogate the RFID tags of the vehicles, calculating an unused time slice of the cycle time for at least one of the traffic flow directions at the intersection; and, reducing the cycle time for the traffic flow.

Likewise JP 2004013199, JP 2004287983, JP 2005352615, JP 2008102738, KR 20040022306, US 2002/0145541, US 2006/0202862, US 2008/0150759 and US 2009/0231160 also disclose a system for regulating the flow of traffic by means of a radio transceiver mounted in the vicinity of an intersection and a radio transceiver mounted on a vehicle.

These prior art systems are only capable of accurately determining that no vehicles are located in a particular lane approaching the intersection and to allocate the flow of traffic accordingly: however, these prior art systems incapable of accurately determining how many vehicles are waiting in line at a given intersection since many intersections in urban areas are spaced from each other by a distance of 50-100 m, a distance which is in the range of an RFID reader. Thus the prior art systems may arrive at an incorrect conclusion that some vehicles are located at an intersection and allocate green light time of the traffic light at that intersection in response to the incorrect conclusion, while in reality those vehicles are located at an adjacent intersection. On the other hand, the RFID reader will not be able to be able to receive information from all of the vehicles at a given intersection if its range is excessively short.

The prior art systems are also liable to arrive at an incorrect conclusion when receiving a signal that originated from a mobile device of a pedestrian or of a bus passenger or the like located at the given intersection.

It is an object of the present invention to provide a system and method for accurately determining the number of vehicles that are approaching an intersection in each direction.

It is an additional object of the present invention to provide a system and method for dynamically and accurately allocating green light time of a traffic light at a given intersection.

It is an additional object of the present invention to provide a system and method for accurately allocating green light time of a traffic light at a given intersection while disregarding signals transmitted from pedestrians or motor vehicle passengers.

Other objects and advantages of the invention will become apparent as the description proceeds.

SUMMARY OF THE INVENTION

The present invention is directed to a method for dynamically and accurately allocating green light time of a traffic light at an intersection, comprising the steps of providing each of a plurality of mobile communication devices, including vehicle mounted communication devices, with a module for periodically transmitting a wireless identifying signal; mounting a control unit in a central region of an intersection having a plurality of traffic lights, said control unit comprising a signal controller in communication with each of said plurality of traffic lights, a signal controller transceiver having one or more directional antennas each of which facing a corresponding approach of said intersection, and a signal controller interface processing unit (SCIPU) in communication with said signal controller and with said signal controller transceiver; receiving an identifying signal by said signal controller transceiver from each of said mobile devices located in the vicinity of said intersection; disregarding those received identifying signals that originated from the mobile device of passengers of a common vehicle or of pedestrians, while considering other received identifying signals as vehicle-specific signals if a value change of a signal strength indication of each of said other received identifying signals is higher than a first predetermined threshold; disregarding one of said vehicle-specific signals if said control unit determines that it originated downstream to said intersection, its value of signal strength indication decreases with time, or a difference between received values of signal strength indication at two adjacent approaches of said intersection, respectively, is less than a second predetermined threshold; determining that a vehicle is located at a given approach of said intersection if a signal strength indication of a corresponding non-disregarded vehicle-specific signal at said approach is greater than a third predetermined threshold and is greater than a signal strength indication of said corresponding vehicle-specific signal received at other approaches of said intersection; disregarding one of said vehicle-specific signals if said control unit determines that it originated upstream to said intersection and its value of signal strength indication as received at approaches of adjacent upstream intersections other than said given approach is less than a fourth predetermined threshold; counting a real-time number of non-disregarded vehicle-specific signals originating from a given approach; and allocating green light time of a traffic light for directing traffic through said given approach in response to the counted real-time number of vehicle-specific signals originating from said given approach.

As referred to herein, an "approach" is a lane or group of lanes along which a vehicle travels leading to, and prior to crossing, a given intersection, associated with a second control unit and a second intersection and upstream from the first control unit and a corresponding first intersection, yet the vehicle unit is within transmission range of the first control unit.

As referred to herein, "upstream" means located in a direction capable of reaching an intersection when traveling with the flow of traffic, and "downstream" means separated from the intersection in a direction along the flow of traffic that leads away from the intersection. When the intersection, for example, is located in an urban area closely separated from adjacent intersections, a vehicle exiting a first intersection is located "downstream" from the first intersection and "upstream" from the second intersection when traveling on the approach to the second intersection.

In one embodiment, a vehicle-specific signal at a certain approach is attributed to a signal group. An approach may be associated with more than one signal groups for example, straight movement through the intersection and left turn, while the instantaneous signal group of vehicles traveling along a given lane group is directed by a corresponding traffic light. Attributing a vehicle-specific signal to a signal group involves a process which identifies moving vehicles by measuring and comparing the changes in received signal strength to a predetermined threshold and if the change of received signal strength is higher than the predetermined threshold then the vehicle carrying said mobile device is moving and attributed to a signal group with green light. If the change in received signal strength is lower than the predetermined threshold than the vehicle carrying said mobile device is attributed to a signal group with red light. If both signal groups have red or green light, attributing the vehicle to a signal group is impossible since the changes in received signal strength of vehicle in both signal groups are similar. Identifying vehicles while both signal groups are red or green is based on measuring the residual queue at a certain signal group after green light and adjusting a compensation counter that changes the green light duration according to the residual queue.

An approach may be associated with a single signal group, for example it may have two lanes while the same light is displayed on all traffic lights of the approach. All vehicle-specific signals associated with said approach are attributed to the single signal group.

In one embodiment, the received non-disregarded vehicle-specific signal is attributed to a turn directing signal group by determining a correlation between an origin approach from which a vehicle associated with the received non-disregarded vehicle-specific signal entered the intersection with a destination approach through which said vehicle has crossed the intersection.

In one embodiment, a number of expected turnable vehicles attributed to the turn directing signal group and waiting for green light time allocation at the origin approach is determined by adding a current number of residual turnable vehicle units located at the origin approach that did not cross the intersection in an immediately previous cycle to a number of turned vehicle units found to have crossed the intersection via the destination approach in said immediately previous cycle. A compensation counter is increased for each residual turnable vehicle unit located at the origin approach, and is decreased by a difference between the number of the expected turnable vehicle units and the number of the turned vehicle units.

In one embodiment, the green light time is allocated by compiling, for each signal group, a list of vehicle-specific signals waiting for green light time; sequentially removing a vehicle-specific signal from the waiting list after the vehicle crosses the intersection; comparing, for each signal group, a determined number of vehicle-specific signals on the waiting list with a number of vehicle-specific signals that have crossed the intersection; and adjusting the allocated green light time if a difference between the determined number of vehicle-specific signals on the waiting list and the number of vehicle-specific signals that have crossed the intersection is greater than a predetermined range of values or if the total number of vehicle-specific signals waiting for green light is less than or equal to the total number of vehicle-specific signals that have crossed the intersection and the last vehicle-specific signal in the waiting list crossed the intersection at a predetermined time before the end of allocated green light time.

In one embodiment, the adjusted green light time is corrected by considering maximum green light time or maximum red light time. The waiting list is adjusted according to the adjusted green light time.

In one embodiment, the received non-disregarded vehicle-specific signal is attributed to the given signal group by measuring changes in a GPS derived location of the mobile device mounted on a corresponding vehicle and comparing said measured changes to a fifth predetermined threshold, whereby said corresponding vehicle is attributed to a red light signal group when said measured changes are less than said fifth predetermined threshold and is attributed to a green light signal group when said measured changes are greater than said fifth predetermined threshold.

In one embodiment, the received non-disregarded vehicle-specific signal is attributed to the given signal group by obtaining data from one or more vehicular sensors and determining thereby an instantaneous travel direction of a corresponding vehicle.

The present invention is also directed to a traffic light system, comprising a plurality of traffic lights for directing the passage of vehicles through an intersection; a vehicle unit provided with a vehicle processing unit and a transceiver, for generating a identifying signal; and a control unit mounted in a central region of said intersection, said control unit comprising a signal controller in communication with each of said plurality of traffic lights, a signal controller transceiver having a directional antenna for receiving identifying signals from said vehicle unit, and a signal controller interface processing unit (SCIPU) in communication with said signal controller and with said signal controller transceiver.

Said SCIPU is operable to disregard those received identifying signals that originated from a mobile device of passengers of a common vehicle or of pedestrians, while considering other received identifying signals as vehicle-specific signals if a value change of a signal strength indication of each of said other received identifying signals is higher than a first predetermined threshold; disregard one of said vehicle-specific signals if said control unit determines that it originated downstream to said intersection, its value of signal strength indication decreases with time, or a difference between received values of signal strength indication at two approaches of said intersection, respectively, is less than a second predetermined threshold; and determine that a vehicle is located at a given approach of said intersection if a signal strength indication of a corresponding non-disregarded vehicle-specific signal at said approach is greater than a third predetermined threshold and is greater than a signal strength indication of said corresponding vehicle-specific signal received at other approaches of said intersection; and count a real-time number of vehicles located on each of said one or more approaches and to allocate a duration of green light time for each of said plurality of traffic lights in response to the real-time number of vehicles located on a corresponding approach.

Said signal controller is operable to control operation of said plurality of traffic lights associated with said intersection in accordance with said allocated green light time.

DETAILED DESCRIPTION OF PREFERRED EMBODIMENTS

The present invention is a system and method for dynamically and accurately allocating green light time of a traffic light at a given intersection by counting the number of vehicles that are located in an approach to a given intersection. A signal controller radio transceiver (SCRT) of a stationary intersection mounted control unit (CU) receives identifying signals transmitted by the on board vehicle radio transceiver (VRT) of vehicles located at an approach to this intersection and also of vehicles located at an approach to upstream intersections. A signal controller interface processing unit (SCIPU) of the CU at the given intersection is operable to disregard the signals transmitted by vehicles located at one or more upstream intersections and by pedestrians and passengers of a common motor vehicle. The number of vehicles located at an approach is thereby counted, allowing the CU to dynamically allocate green light time of a corresponding traffic light in accordance with traffic volume, traffic arrangement, for example per approach or per signal group, and design preferences.

Although the signals transmitted by the vehicles are described as being transmitted through a cellular network, it will be appreciated that the invention is also applicable when they are transmitted in any other wireless frequency band or network, such as Wi-Fi. Bluetooth and DSRC.

Figure 1:
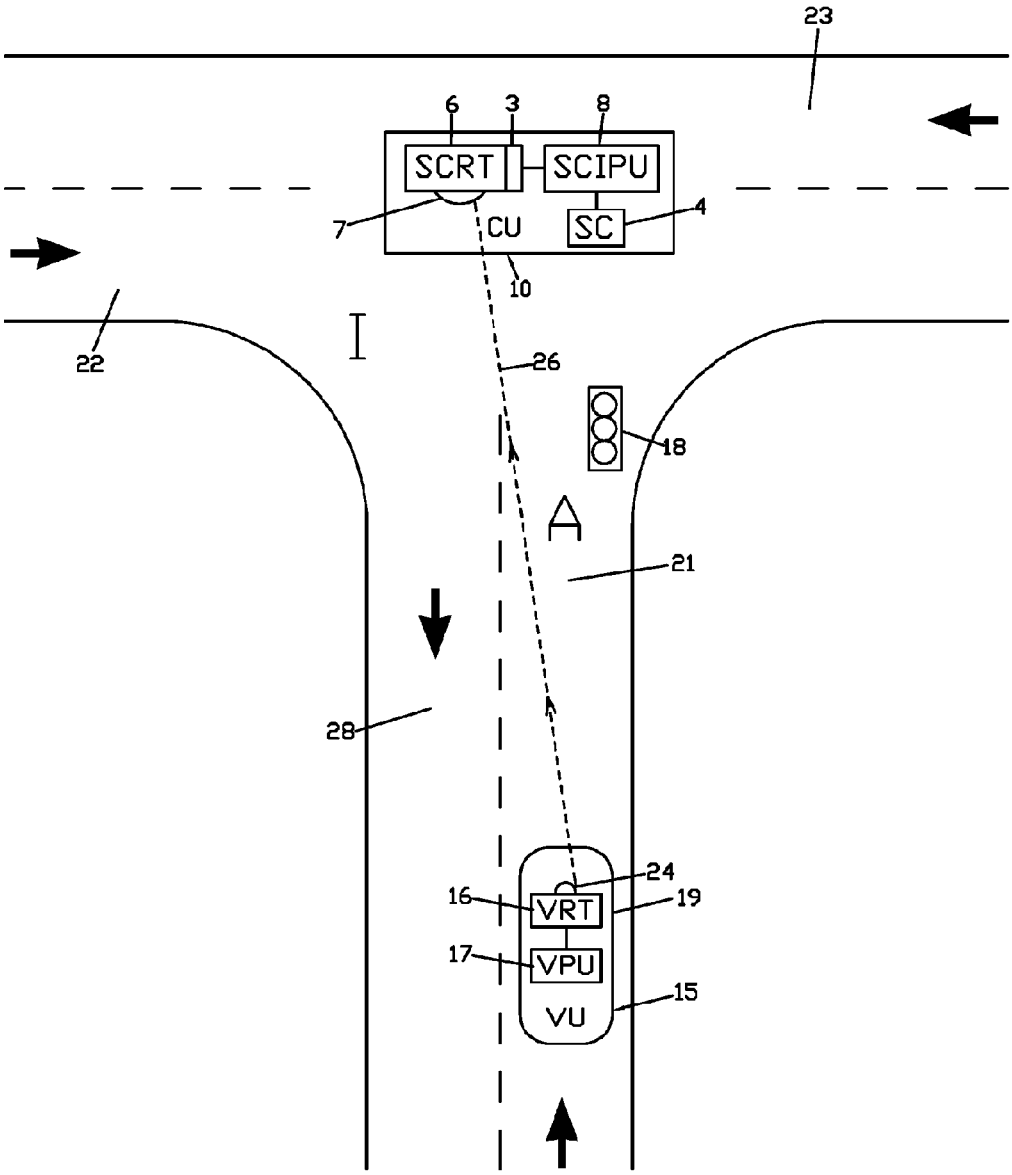
FIG. 1 is a schematic illustration of a traffic light system according to one embodiment of the present invention, shown with respect to one approach to an intersection.

The system operates as follows:

1. The Signal Controller (SC) 4 is mounted at an intersection and regulates the traffic by traffic lights 18 mounted at every approach of the intersection as illustrated in FIG. 1. SC 4 is operated by a CPU that is provided with an algorithm that allocates green time to every phase group at a predefined phase group sequence.

2. The vehicle unit (VU) 15 comprises a vehicle radio transceiver (VRT) 16, e.g. a cell phone radio link, a vehicular Bluetooth radio link, or any other DSRC transceiver, and a vehicle processing unit (VPU) 17, e.g. cell phone CPU or a CPU of an In-Vehicle Infotainment (IVI) unit, with a relevant application in communication with VRT 16. The VPU 17 sends a signal modulated with a decoding key (VBC) during every predetermined time period. Each VPU 17 has a unique encoding key based on the transceiver identifier, e.g. cell phone number MAC address, and, in one embodiment, the type of vehicle (private car, small truck, bus, semi-trailer, etc.) in which VU 15 is mounted. The encoding key is used to produce a Vehicle Binary Code (VBC) that is unique to the corresponding VU. The VRT 16 modulates the radio waves with the VBC and transmits it to the SCRT 6 located at the intersection.

3. The SCRT 6 comprises a radio receiver, a CPU unit 3, and directional antennas 7 each of which being directed to a corresponding approach. The SCRT 6 receives a signal, demodulates the signal to extract the VBC and measures the RSSI value of the signal. SCRT 6 may be adapted to analyze VBCs received from adjacent downstream and upstream intersections, or alternatively may be limited to the frequency range of a short-range signal.

In order to determine that a VBC associated with a VU 15 is waiting at a particular approach at the given intersection, the SCIPU 8 implements the following process:

1. The SCRT 6 receives a signal with a modulated VBC from each VRT 16 mounted on a traveling vehicle at an approach. The SCRT 6 measures the received signal strength index RSSI of each signal.

2. For each received signal modulated with a certain VBC at the current intersection, the CU 10 receives the RSSI value of said signal received by the directional antenna 7 of adjacent approaches.

3. SCIPU 8 collects the VBC and the associated RSSI values of every VU 15 and applies certain rules for each approach as follows:

3.1 disregarding the VBC if the RSSI value decreases with time.

3.2 disregarding the VBC if the difference between the RSSI value of a received signal (associated with said VBC) in the given approach and any other adjacent approach of said intersection is less than a predetermined threshold.

3.3 disregarding the VBC if the RSSI value of said VBC in adjacent upstream intersections is higher than the RSSI value received in said approach.

3.4 determining that a VU is located at a certain approach if the RSSI value (associated with said VBC) received at said approach is greater than a predetermined threshold and increases with time, and is higher than the RSSI value received at other approaches of said intersection.

Figure 2:
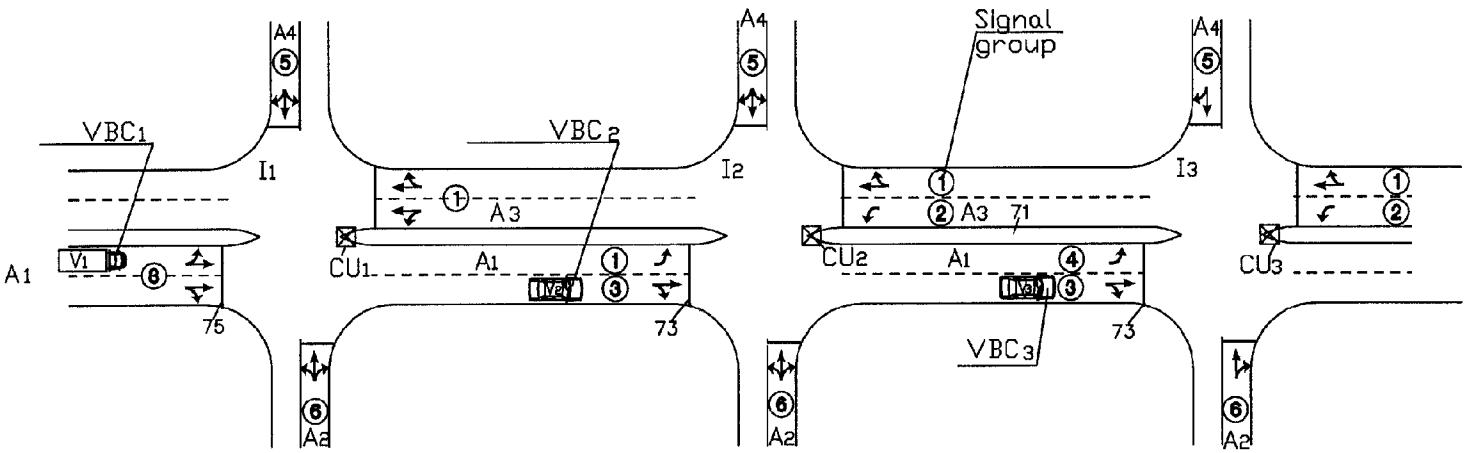
FIG. 2 is a schematic illustration of the traffic light system of FIG. 1, shown with respect to three intersections.

FIG. 2 illustrates a form of three adjacent intersections wherein two vehicles are located at two different approaches, as follows:

Vehicle V1 is located at approach A1 of intersection I1.

Vehicle V2 is located at approach A1 of intersection I2.

Vehicle V1 is traveling in approach A1 in intersection I1 towards the stop line 75. CU1 at intersection I1 has four directional antennas, each of which is directed towards a certain approach. The signal generated by the VU of vehicle V1 modulated by VBC1 is received by each directional antenna. Since a directional antenna receives the strongest signal from the preferred direction, then the signal received in approach A1 has the higher RSSI value and therefore CU1 determines that the location of the VU associated with vehicle V1 is at approach A1. The same process applies to V2 at CU2.

Vehicle V2 is traveling downstream away from CU1 of intersection I1 towards intersection I2. The signal generated from the VU associated with VBC2 and vehicle V2 is received at CU1, CU2, CU3. CU1 at approach A3 receives the signal. Since the RSSI of said signal decreases with time, CU1 disregards VBC2.

CU2 at approach A1 receives signals associated with VBC1 and VBC2. Since VBC2 is disregarded by CU1, then CU2 is operable to determine that VBC2 is located at approach A1 of intersection I2. CU2 compares the RSSI value of VBC1 as received at approach A1 of CU2 to the RSSI value of VBC1 as received at approach A1 of CU1. CU2 is operable to determine that VBC1 is located at approach A1 of intersection I1 if the RSSI value of VBC1 received by CU1 is higher within a predetermined threshold than the RSSI value of VBC1 received at approach A1 of CU2 in intersection I2.

A control unit at a given intersection is able to determine that a vehicle exiting an upstream intersection is approaching the given intersection even though the RSSI value is less at the given intersection that at the upstream intersection, due to the change in detected RSSI value.

4. The VBC extracted from the SCRT 6 for every intersection approach is analyzed by the SCIPU 8 in order to attribute the VBC to a pedestrian or passenger vehicle/commercial vehicle or bus passenger, to allocate the VBC to a certain signal group at a certain intersection approach and to allocate green light time to every signal group according to the waiting VBCs at every signal group respectively.

The process comprises four main stages as follows:

Stage 1—a process that identifies and attributes a VBC to a bus passenger, car entering the intersection i.e., VU 15, car leaving the intersection, or pedestrian.

Stage 2—a process that attributes a VBC identified as a vehicle unit VU to a signal group.

Stage 3—a process that identifies vehicles accumulated at a left turn signal group at a certain approach during a common green or red light at said approach.

Stage 4—a process that allocates and adjusts the green light time for every signal group according to the waiting VBCs at every signal group.

Each stage includes several steps that check the changes of the received signal strength index RSSI of a VBC generated by a VU as follows:

4.1 Stage 1

Figure 3:
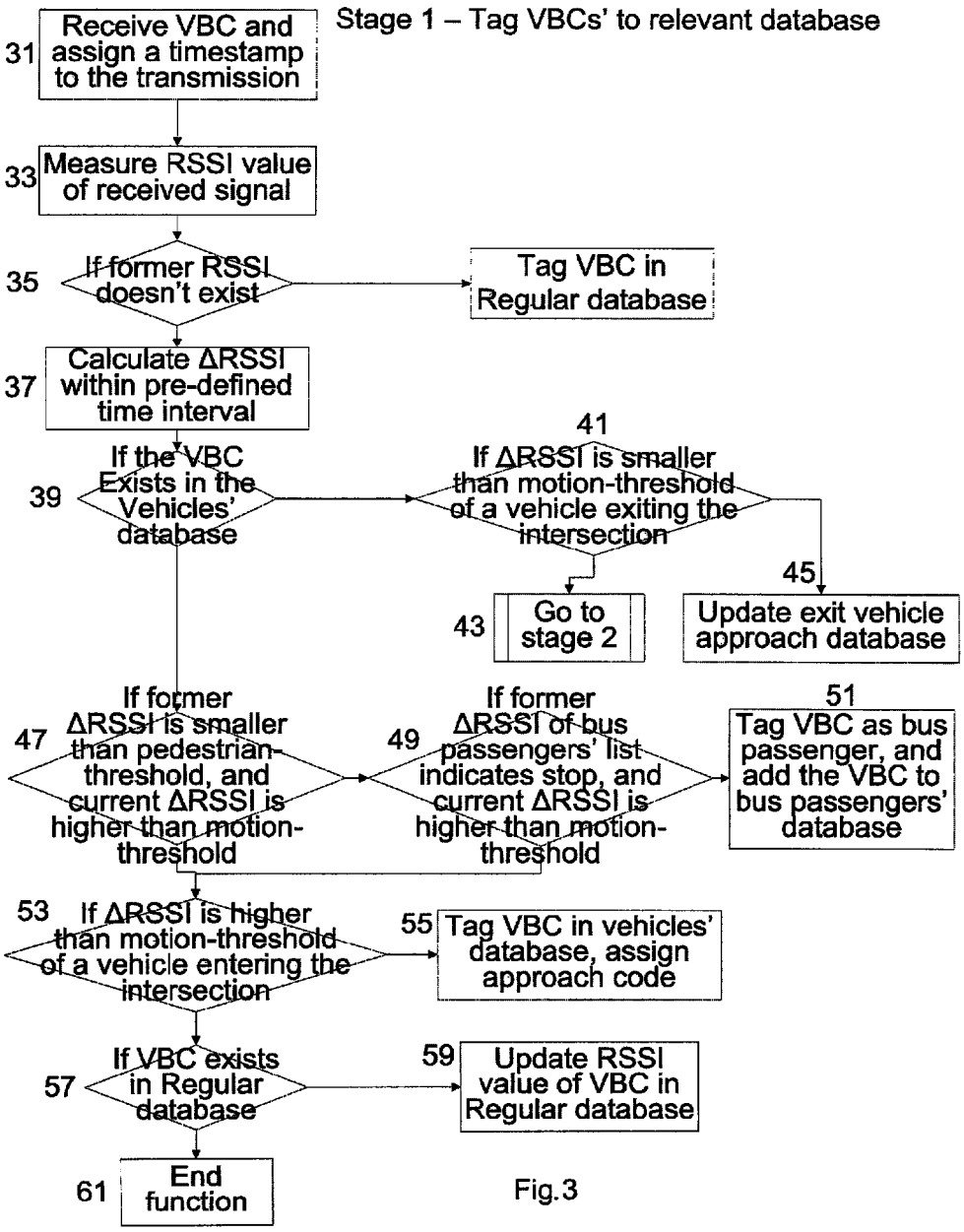
FIG. 3 is a method for attributing an identifying signal to the corresponding type of user.

FIG. 3 illustrates a process that attributes a VBC to the corresponding type of user from whose mobile device the identifying signal originated, whether the user is located within a vehicle unit, such as a passenger vehicle, a bus passenger, or a pedestrian.

Calculating changes in the RSSI value of a received signal modulated with a specific VBC includes the following steps:

31—Receiving a certain VBC from the SCRT 6 and assigning a time stamp to the VBC.

33—Measuring the RSSI level of the received signal associated with said VBC.

35—If the VBC has no former RSSI value, the VBC with its associated timestamp and RSSI is stored in a regular database.

37—If there is a former RSSI value associated with the VBC, the system calculates ΔRSSI (difference of RSSI value) within a predetermined time interval.

When one or more passengers of a common motor vehicle transmit a signal, the system is able to filter out all of their corresponding transmitted signals upon determining that they all have a same RSSI related pattern, for purposes of green light allocation.

For example, identifying the VBC and attributing it to a bus passenger in steps 47-51 is based on analyzing the change in ΔRSSI of a VBC not existing in the vehicles database i.e., a VBC that is tagged as a bus passenger or as a pedestrian. If the former ΔRSSI of said VBC is less than a pedestrian threshold, meaning that the VBC is moving slowly as a pedestrian, and if the current ΔRSSI is higher than a motion threshold, then it is assumed that a pedestrian is waiting at a bus station or got onboard a bus.

An additional verification step is taken by measuring the ΔRSSI of the bus passenger list. If the previous value of bus passenger database was lower than the pedestrian threshold and the current ΔRSSI is higher than the motion threshold, there is an indication that the bus stopped at a bus stop and is currently leaving the station while the VBC is being transmitted onboard.

The process is based on two substeps, as follows:

47—Substep 1—Comparing values of current and former ΔRSSI to the motion threshold and pedestrian threshold, respectively. If the current ΔRSSI is higher than the motion threshold and the former ΔRSSI is less than the pedestrian threshold, then the process proceeds to Substep 2.

49—Substep 2—Comparing the values of the current and former ΔRSSI for each bus passenger. If the former ΔRSSI of a bus passenger is indicative of a stopped state and the current ΔRSSI is higher than the motion threshold, then the VBC is tagged as a bus passenger and is added to the passenger database of the bus in step 51.

Identifying the VBC and attributing it to a car passenger/commercial vehicle, i.e. a VU, is carried out in steps 53-55. If the ΔRSSI is higher than the motion threshold of a vehicle entering the intersection in step 53, the VBC is tagged in the vehicle database and an approach code is assigned to the VBC in step 55.

If a VBC is not identified as bus passenger or car passenger/commercial vehicle, then the VBC is tagged as a regular VBC and added to the regular database in step 59.

The SCIPU checks the received VBCs after every predetermined time interval and applies the steps described above. A VBC that exists in the vehicle database and is entering an approach is directed in step 43 to Stage 2, which identifies and attributes the VBC to a signal group. A VBC that crossed the intersection and exits an approach in an opposite direction to a vehicle entering the approach is tagged as an exit vehicle and is added to an exit vehicle approach database in step 45. A VBC that is not identified as a vehicle is checked in steps 47-55, and since it is not attributed as a vehicle,—the RSSI value of the VBC is repeatedly updated in steps 57, 59 in order to identify pedestrians that went onboard a bus in steps 47-51.

It will be appreciated that Stage 1 may be implemented when the wireless identifying signal is a short-range wireless identifying signal and the signal controller transceiver is a short-range transceiver.

4.2 Stage 2

Figure 4:
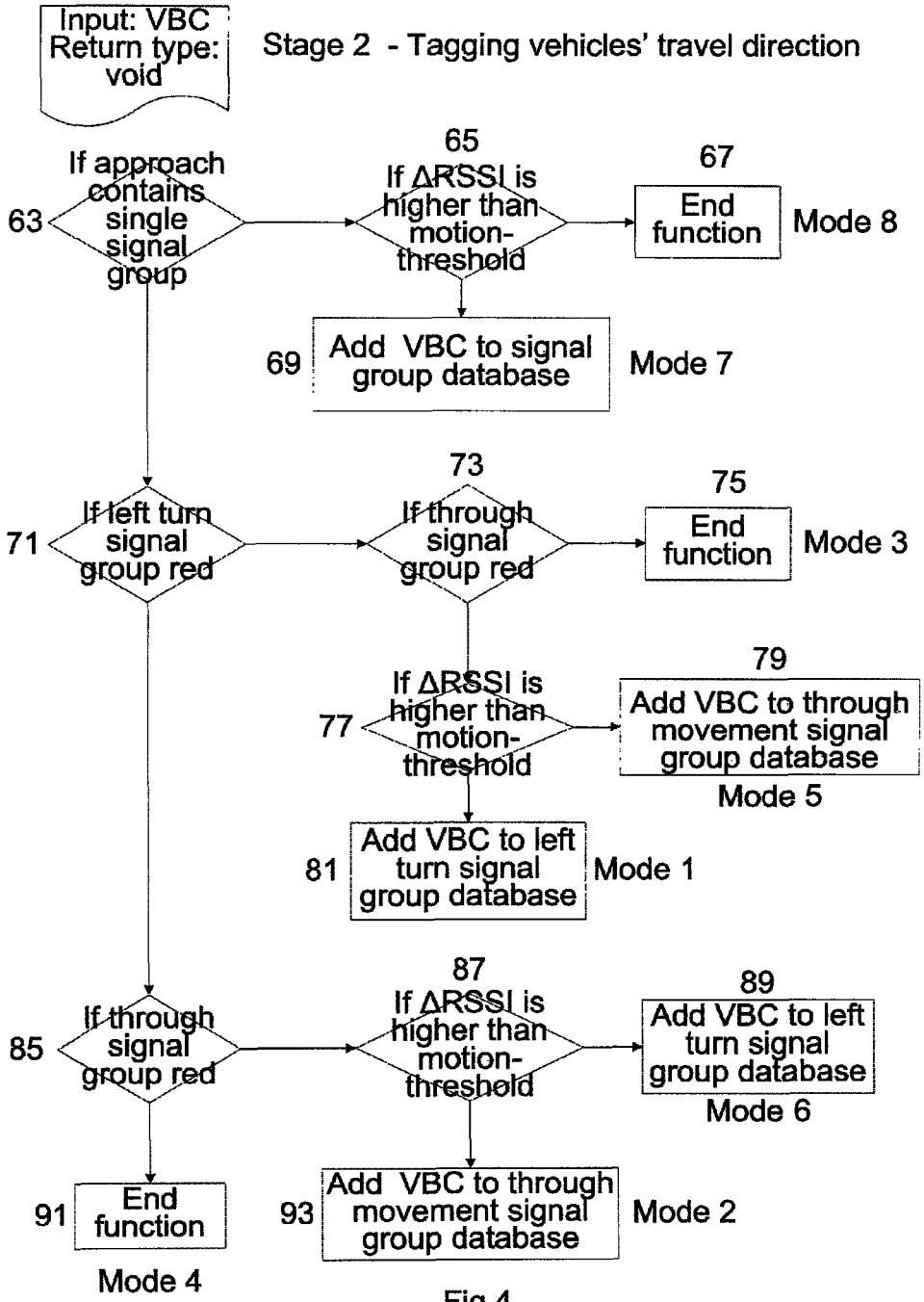
FIG. 4 is a method for attributing a vehicle-specific signal to a signal group.

As shown in FIG. 4, every VBC in the vehicle database at a certain approach is attributed to a certain signal group associated with said approach according to the direction movement of the VU (left, through, or right) in Stage 2. The VBC is then added to a database related to said signal group. The process for attributing a VBC to a signal group is indicated by a mode identifier.

Attributing VU to a Signal Group by a Single Signal Group Approach

If an approach has only a single signal group, then all VUs at said approach are attributed to said signal group.

One process is based on measuring the ΔRSSI of each signal associated with a VBC at a red light of said approach and associating a VU to said signal group if the ΔRSSI is lower than the motion threshold. The VBC associated with said VU is then added to the signal group database. This process is indicated as Mode 7 at step sequence 63-65-69.

After the signal group displays amber or green lights, the VUs consequently advance through the intersection, their ΔRSSI is higher than the motion threshold, and the process indicated as Mode 8 is terminated at step sequence 63-65-67.

Figure 5A:
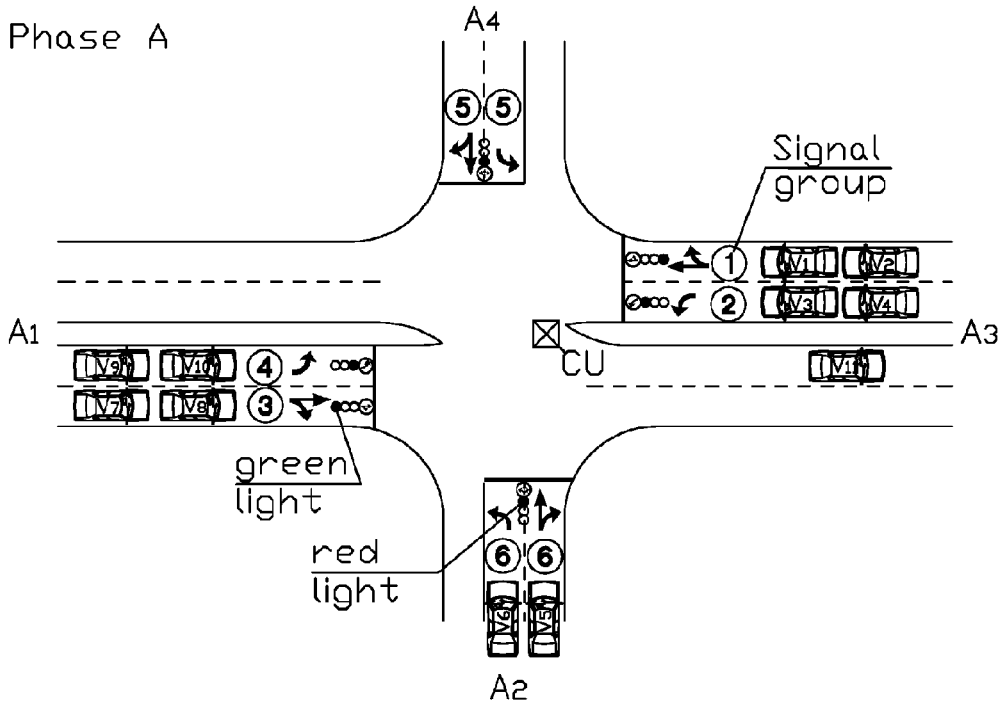
FIGS. 5*a-e* are schematic illustrations of five phases, respectively, of traffic signals at an intersection, showing how a vehicle is attributed to a corresponding signal group during each phase.
Figure 5B:
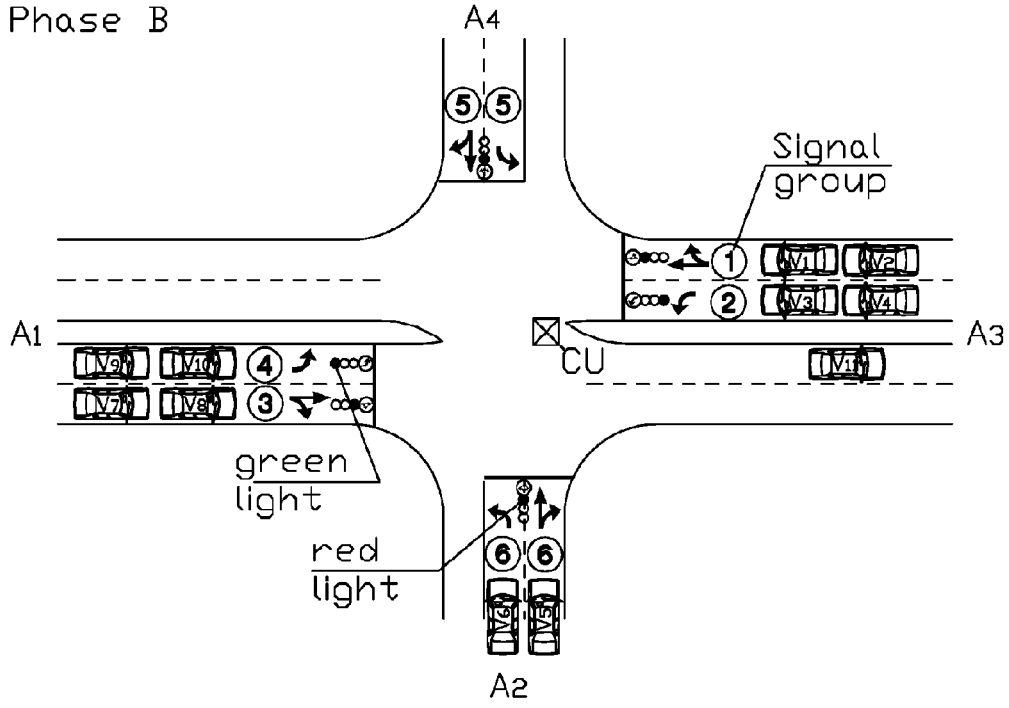
Figure 5C:
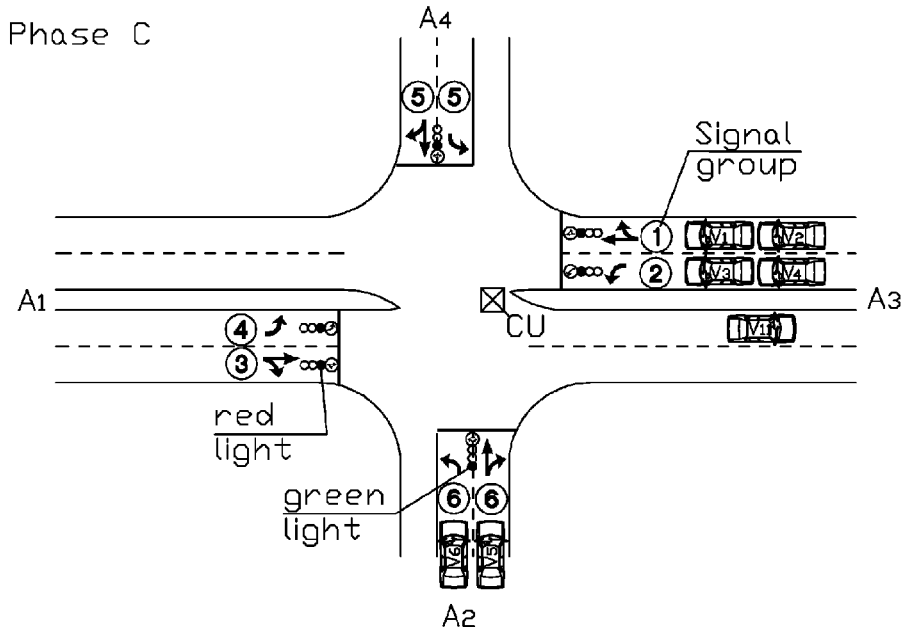

FIG. 5*a* illustrates vehicles V5, V6 at signal group 6 as waiting at a red light and therefore are in Mode 7, while FIG. 5*c* illustrates said vehicles as being presented with a green light and therefore are in Mode 8.

Attributing VU to a Signal Group at a Multi-Signal Group Approach

The method of identifying the direction movement of a VU if a certain approach has two or more signal groups is based on differentiating between the ΔRSSI of a moving VU traveling at a green or amber light and the ΔRSSI of a non-moving VU waiting at a red light in accordance with the current signal group lights (red, green or amber) associated with a certain approach.

The process is implemented when two or more signal groups have different signal lights, e.g., one signal group has a red light while the other signal group has amber or green light.

The method includes several modes for different situations of the signal group lights that occur during an entire cycle of the signals, as described herein:

1. Modes 1, 2—attributing VU for certain signal group at a red light while the other signal groups have a green or amber light. The process is based on measuring the ΔRSSI of each VU and associating the VU to a red light signal group if the ΔRSSI is lower than the motion threshold. This process is indicated as Mode 1 for a red light, left turn signal group at step sequence 71-73-77-81 and as Mode 2 for a through movement signal group at step sequence 71-85-87-93. It will be appreciated that this process may also be implemented for right turn signal groups.

FIG. 5*a* shows vehicles V3, V4 at signal group 2 and vehicles V9, V10 at signal group 4 waiting at a red light and therefore are in Mode 1, while vehicles V1, V2 at signal group 1 and vehicles V7, V8 at signal group 3 have a green light and therefore are in Mode 5. Vehicles V5, V6 in signal group 6 are waiting at a red light and therefore are in Mode 7.

FIG. 5*b* shows vehicles V1, V2 at signal group 1 and vehicles V7, V8 at signal group 3 waiting at a red light and therefore are in Mode 2, while vehicles V3, V4 at signal group 2 and vehicles V9, V10 at signal group 4 have a green light and therefore are in Mode 6. Vehicles V5, V6 in signal group 6 are waiting at a red light and therefore are in Mode 7.

2. Mode 3—all signal group lights are red.

If all signal groups at a given approach are red, then the ΔRSSI of the VU associated with said signal groups are similar and no differentiation is possible. The process therefore ends, as indicated by Mode 3 in step sequence 71-73-75.

FIG. 5*c* shows vehicles V1, V2 at signal group 1 and vehicles V3, V4 at signal group 2 waiting at a red light, and therefore are in Mode 3. Vehicles V5, V6 in signal group 6 have a green light and therefore are in Mode 8.

3. Mode 4—all signal group lights are green.

If all signal group lights at a given approach are green, then the ΔRSSI of all VUs are similar and no differentiation is possible. The process therefore ends, as indicated by Mode 4 in step sequence 71-85-91.

Figure 5D:
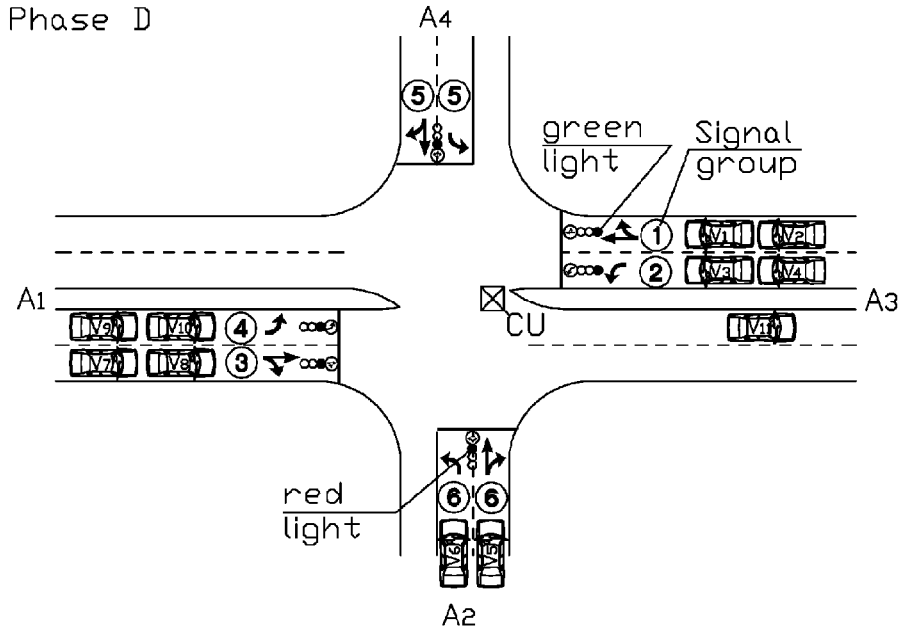
Figure 5E:
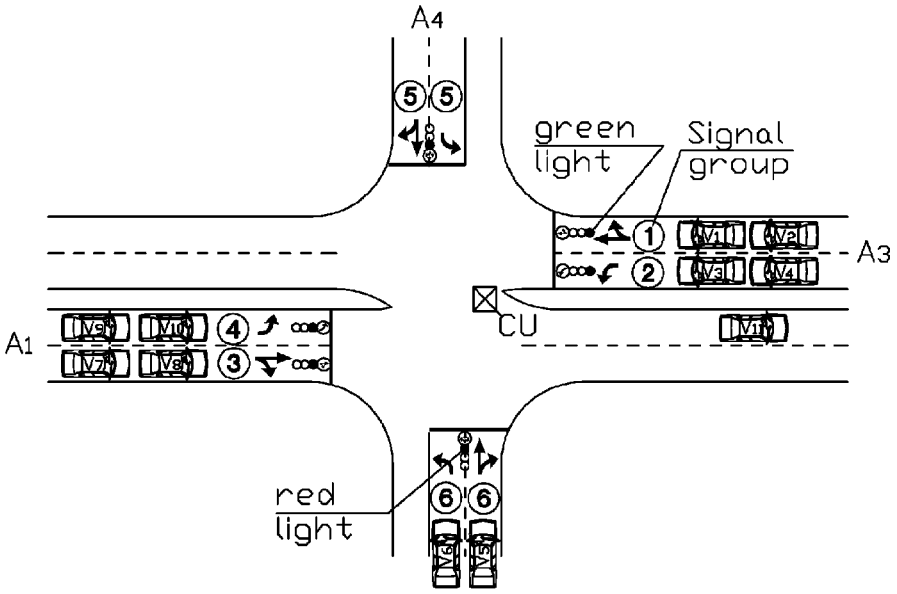

FIG. 5*d* shows vehicles V1, V2 at signal group 1 and vehicles V3, V4 at signal group 2 traveling through a green light and therefore are in Mode 4. Vehicles V7, V8 at signal groups 3 and vehicles V9, V10 at signal group 4 have a red light and therefore are in Mode 3. Vehicles V5, V6 in signal group 6 are waiting at a red light and therefore are in Mode 7.

4. Modes 5, 6—attributing the VU to a certain signal group at amber or green light while the other signal groups have red light. Vehicles accumulated in Mode 3 while both signal groups have a red light (therefore not attributed) are attributed in Modes 5, 6 to their signal groups while the signal group has green or amber light.

The process is based on measuring the ΔRSSI of each VU and associating the VU to a signal group with green or amber light if the ΔRSSI is higher than the motion threshold. This process is indicated as Mode 6 for left turn signal group at step sequence 71-85-87-89 and as Mode 5 for through movement signal group at step sequence 71-73-77-79. It will be appreciated that this process may also be implemented for right turn signal groups.

In one embodiment, the process of attributing a VU at a given approach to a signal group in Modes 1, 2, 5, 6, 7, and 8 can be performed by measuring changes in a VU's GPS location instead of its measured ΔRSSI value. Thus the measured changes of a GPS based location will indicate that a VU is traveling towards the intersection, corresponding to an increase in the ΔRSSI value. Alternatively, the measured changes of a GPS based location will indicate that a VU is traveling away from the intersection, corresponding to a decrease in the ΔRSSI value.

The process of attributing a VU at a given approach to a signal group database may also be based on an instantaneous travel direction of a vehicle detected by means of one or more vehicular sensors.

The operation of a traffic signal is based on several phases that form a cycle. Each phase represents a flow of traffic in certain signal groups which have a green light while the rest of the signal groups have red light. For each phase, a certain traffic light mode is active at each approach.

For example, FIG. 5*a* illustrates phase based signal groups 1,3 having a green light and signal groups 2,4,5,6 having a red light. During the operation of the phase, vehicles at approaches A1, A3 can be attributed to their signal groups. Vehicles traveling through the intersection in signal groups 1,3 during green light time are identified in Mode 5, left turn vehicles in signal groups 2,4 waiting at the red light are identified in Mode 1. Vehicles in signal groups 5,6 waiting at red light are identified in Mode 7.

4.3 Stage 3

Figure 6:
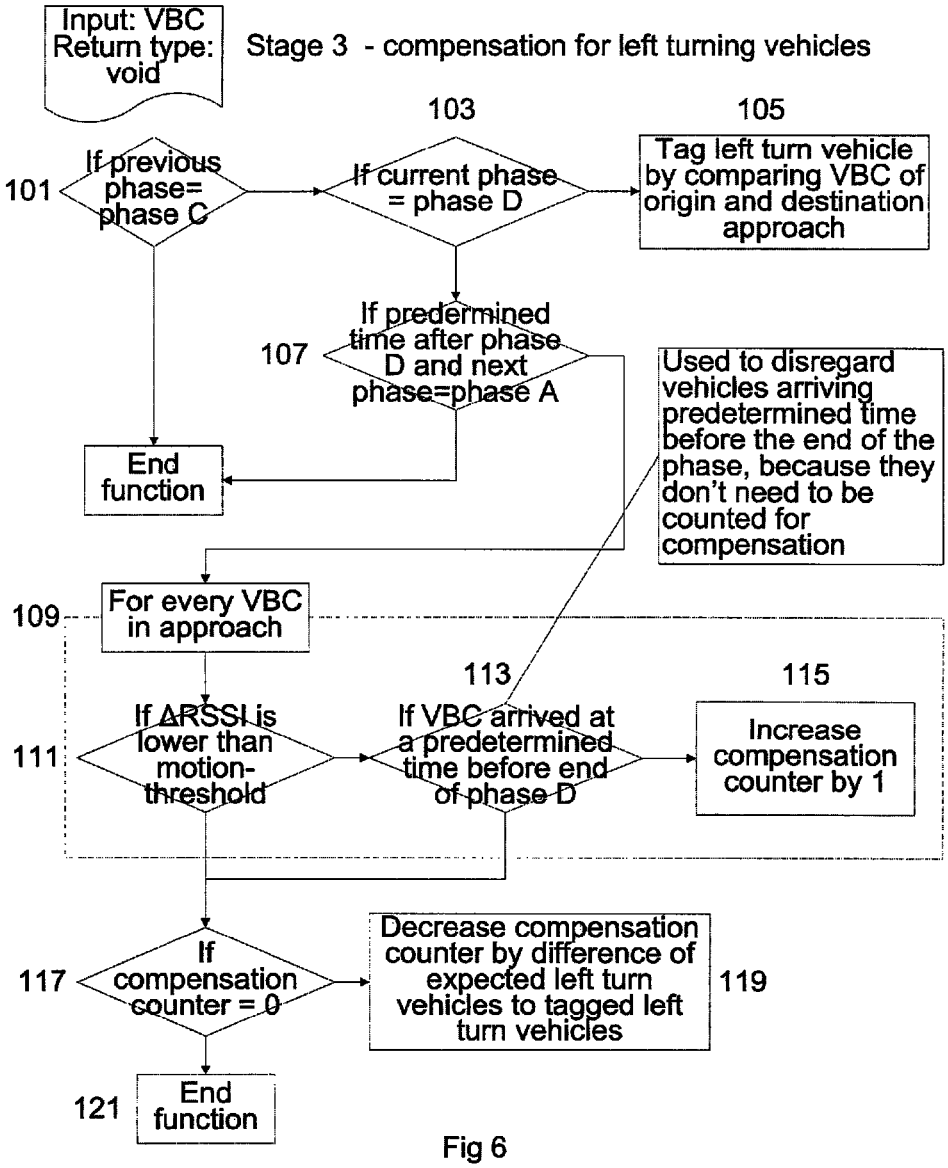
FIG. 6 is a method for compensating a turn directing signal group for changes in the number of vehicle units that are waiting for green light time.

FIG. 6 illustrates a process that compensates a turn directing signal group, such as a left turn signal group, for changes in the number of VUs that are waiting for green light time when a waiting VU cannot be readily attributed to the turn directing signal group. During the operation of a traffic signal, an approach having two signal groups has a phase sequence that is based on the following sequence: (1) phase C-(2) phase D-(3) phase A. The VUs accumulating at a red light in phase C cannot always be attributed to a correct signal group at phase D because the VUs at both signal groups, e.g. a left turn signal group and a straight through signal group, advance simultaneously and their ΔRSSI is similar.

In order to overcome this drawback, the system runs a process during Stage 3 that identifies all VUs that have accumulated at a left turn signal group during phase C, and updates a compensation left turn counter that adds each relevant VU to a left turn signal group database. The process establishes a predetermined default time interval for each VU to cross the intersection.

The process starts at steps 101-103, and if the phase sequence is initiated, then during phase D at step 105 the left turned VUs at said approach are identified by comparing the origin approach from which the VU entered the intersection and the destination approach along which the VU traveled and crossed the intersection, or to which the VU is expected to cross the intersection. If the VU associated with said VBC turned left, then the VU is tagged as a "left turned VU".

FIG. 5*d* illustrates vehicles V3, V4 that are associated with signal group 2 and are turning left from approach A3 to approach A2. The directional antenna of the CU associated with approach A3 receives the signals modulated with the VBC of vehicles V3, V4 in signal group 2. After the vehicle turned left, the directional antenna associated with approach A2 receives signals modulated with the VBC of vehicles V3, V4 (step 45 of Stage 1). If said VBC was received while entering the intersection at approach A3 and exiting the intersection at approach A2, then the VU is known to have turned left and is tagged as a left turned VU.

The process continues and counts the number of VUs that are included in the vehicle approach database that arrived at a predetermined time before the end of phase D, did not cross the intersection, and their RSSI is lower than the motion threshold. These VUs of a turn directing signal group that are waiting for green light time and were not able to cross the intersection are identified for example as "residual left turnable VUs". A compensation counter is increased by one VU for each identified residual left turnable VU.

Finding residual left turnable VUs may involve coordinating a phase change such that a left turn lane will be presented with a red light while a straight through lane is presented with a green light. Thus only those VUs that have stopped and are waiting for a green light may be included in the residual left turnable VU database.

The "expected left turnable VUs" considered for green light time allocation at the next cycle is calculated by adding the number of residual left turnable VUs to the number of left turned VUs.

At times, the number of VUs waiting for green light time may be less than the number of VUs that have crossed the intersection. Accordingly, if the number of residual left turnable VUs of said approach is 0, i.e. the number of left turned VUs that crossed the intersection within the green light time allocation time is equal to or less than the expected left turnable VUs, then the compensation counter is decreased by the difference between the number of expected left turnable VUs to the number of left turned VUs, in order to correspondingly decrease the green light allocation for the left turn signal group.

Following the default time interval from the end of the green light of phase D, and if the next phase is phase A (step 107), vehicles at signal group 2 that did not cross the intersection are waiting at a red light while vehicles at signal group 1 are travelling through a green light. The system performs for every VBC at step 109 measurements of ΔRSSI of the received signal associated with each VBC. If the ΔRSSI is lower than the motion threshold (step 111) and the VBC has been received at a predetermined time before the end of phase D (step 113), then the compensation counter is increased by one VU in response to the number of left turnable VUs. After all residual left turnable VUs at signal group 2 were identified, the system checks the compensation counter at step 117. If the compensation counter is 0, meaning that the number of left turned VUs is equal to or less than the number of expected left turnable VUs, then the compensation counter is decreased in step 119 by the difference between the expected number of left turnable VUs and the number of left turned VUs identified at step 105. If the compensation counter is greater than 0, the process ends at step 121.

The total green time allocation for signal group 2 is determined according to the number of VUs that have crossed the intersection in the current cycle and have been accumulated at signal group 2, as set by the value of the compensation counter in the previous cycle.

It will be appreciated that Stage 3 may be implemented for any signal group, including one that is not related to a turn directing signal group.

4.4 Stage 4

Figure 7:
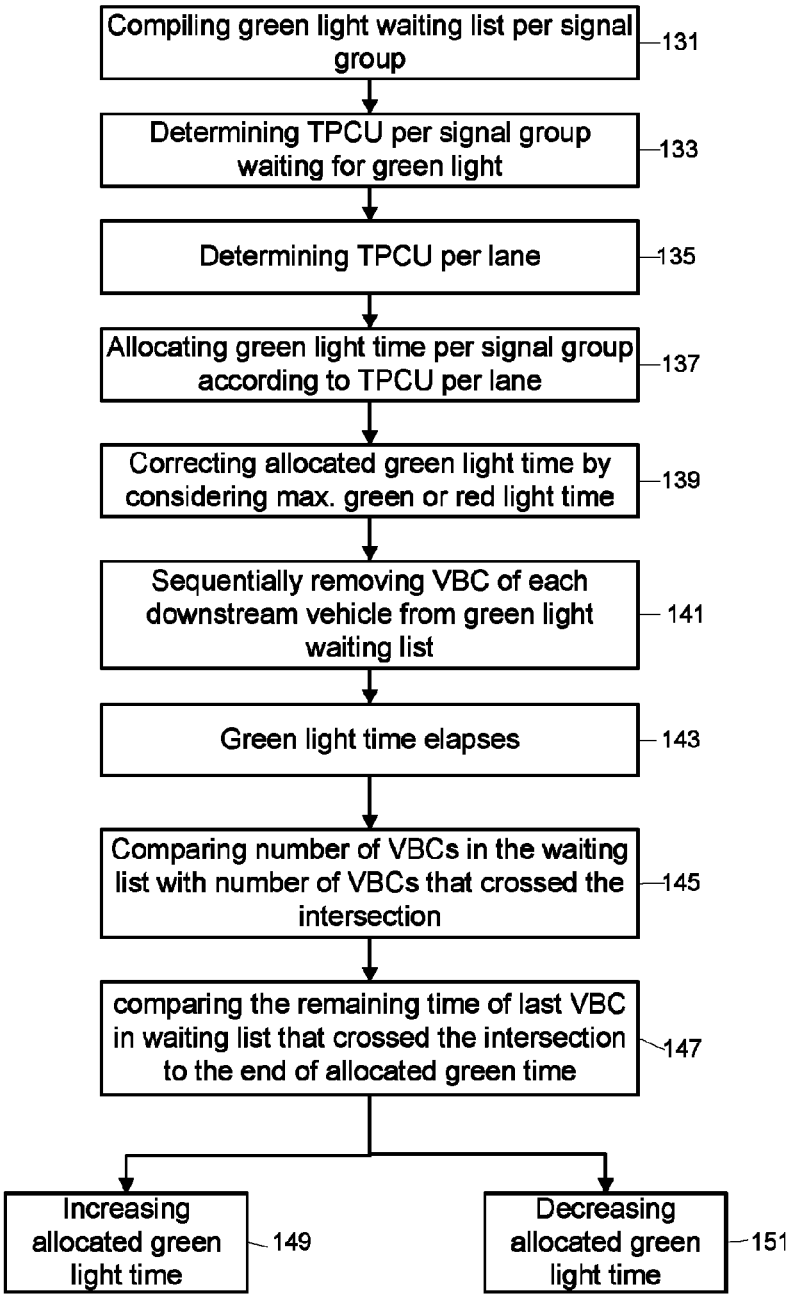
FIG. 7 is a method for dynamically and accurately allocating green light time of a traffic light at an intersection, according to one embodiment of the invention.

FIG. 7 illustrates a process of allocating green light time to every signal group. Approximately, at the end of the red light time, the SCIPU compiles a waiting list in step 131, based on the received VBCs, of the number and type of vehicles for each signal group that are waiting for a green light. Each vehicle type has a predetermined number of Passenger Car Units (PCUs), depending on its size. For example, a passenger vehicle will have a smaller number of PCUs than a truck. The SCIPU then determines in step 133 the total passenger car units (TPCU) for each signal group that are waiting for a green light, which is equal to the sum of each product of the number of a given vehicle type and the corresponding PCU. The TPCU per lane is determined in step 135 by dividing the TPCU by the number of lanes associated with each signal group. A nominal green light time is then allocated for each signal group in step 137 as a function of the TPCU per lane.

If the SCIPU determines, for any signal group, that the allocated green light time is greater than a predetermined maximum green light time, or a calculated red light time, i.e. waiting time, is greater than a predetermined value, the SCIPU accordingly corrects the allocated green light time in step 139 and also reduces the number of VBCs in the waiting list by a predetermined value, to compensate for the reduced allocated green light time.

When the green light is displayed and vehicles cross the intersection, the VBC of each vehicle unit, mounted on a vehicle that is located downstream from the intersection is no longer received by the control unit or the value of RSSI decreases with time, thereby implicating that the vehicle is moving downstream away from the intersection. The SCIPU therefore sequentially removes in step 141 the VBC of each downstream vehicle from the green light waiting list, until the allocated green light time elapses in step 143 or until all vehicles on the waiting list have crossed the intersection.

After a predetermined number of cycles, the total number of VBCs that crossed the intersection is compared in step 145 with the total number of VBCs in the waiting list that were waiting for green light. If the difference between the total number of VBCs in the waiting list that were waiting for green light time and the total number of VBCs that have crossed the intersection, is greater than a predetermined threshold, the allocated green light time per PCU is increased in step 149 in order to compensate for vehicles not equipped with VRT e.g., cell phone or not equipped with VPU e.g. cell phone CPU with a relevant application or in order to compensate for stationary, excessively slow moving vehicles that are blocking the passage of vehicles along one or more lanes of the signal group, for example, due to an accident or the passage of a truck. If, however, the total number of VBCs that were waiting for green light is less than, or equal to, the total number of VBCs that have crossed the intersection and the last VBC in the waiting list crossed the intersection at a predetermined time before the end of allocated green light time (step 147), indicating that the allocated green light time is longer than required, the allocated green light time per PCU is decreased in step 151.

This process is repeated for each signal group of each approach to form a cycle.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A method for dynamically and accurately allocating green light time of a traffic light at an intersection, comprising the steps of:

a) providing each of a plurality of mobile communication devices, including vehicle mounted communication devices, with a module for periodically transmitting a wireless identifying signal;

b) mounting a control unit in a central region of the intersection having a plurality of traffic lights, said control unit comprising a signal controller in communication with each of said plurality of traffic lights, a signal controller transceiver having one or more directional antennas each of which faces a corresponding approach of said intersection, and a signal controller interface processing unit (SCIPU) in communication with said signal controller and with said signal controller transceiver;

c) receiving the wireless identifying signals by said signal controller transceiver from each of said mobile communication devices of the plurality of mobile communication devices located in the vicinity of said intersection;

d) disregarding those received wireless identifying signals that originated from the mobile communication device of passengers of a common vehicle or of pedestrians, while considering the other received wireless identifying signals as vehicle-specific signals if a value change of a signal strength indication of each of the other received identifying signals is higher than a first predetermined threshold;

e) disregarding one of said vehicle-specific signals if said control unit determines that it originated downstream to said intersection, its value of signal strength indication decreases with time, or a difference between the values of signal strength indication received at two approaches of said intersection, respectively, is less than a second predetermined threshold;

f) determining that a vehicle is located at a given approach of said intersection if the value of the signal strength indication of a corresponding non-disregarded vehicle-specific signal at said given approach is greater than a third predetermined threshold and is greater than the value of the signal strength indication of said corresponding non-disregarded vehicle-specific signal received at other approaches of said intersection;

g) disregarding one of said vehicle-specific signals if said control unit determines that it originated upstream to said intersection and its value of signal strength indication as received at approaches of adjacent upstream intersections other than said given approach is less than a fourth predetermined threshold;

h) counting a real-time number of non-disregarded vehicle-specific signals originating from a given approach; and i) allocating green light time of a traffic light of the plurality of traffic lights for directing traffic through said given approach in response to the counted real-time number of non-disregarded vehicle-specific signals originating from said given approach.

2. The method according to claim 1, wherein each respective non-disregarded vehicle-specific signal is attributed to a given signal group of the given approach and is added to a database of said given signal group.

3. The method according to claim 2, wherein each respective non-disregarded vehicle-specific signal is attributed to the respective given signal group by measuring the value change of the signal strength indication of the received wireless identifying signal and comparing said measured value to a predetermined motion threshold.

4. The method according to claim 3, wherein a respective non-disregarded vehicle-specific signal of the respective non-disregarded vehicle-specific signals is attributed to a green light signal group if its value change of its signal strength indication is higher than the predetermined motion threshold and is attributed to a red light signal group if its value change of its signal strength indication is lower than the predetermined motion threshold.

5. The method according to claim 2, wherein a respective non-disregarded vehicle-specific signal of the respective non-disregarded vehicle-specific signals is attributed to a turn directing signal group by determining a correlation between an origin approach from which a vehicle associated with the respective non-disregarded vehicle-specific signal entered the intersection with a destination approach through which said vehicle has crossed the intersection.

6. The method according to claim 5, wherein a number of expected turnable vehicles attributed to the turn directing signal group and waiting for green light time allocation at the origin approach is determined by adding a current number of residual turnable vehicles located at the origin approach that did not cross the intersection in an immediately previous cycle to a number of turned vehicles found to have crossed the intersection via the destination approach in said immediately previous cycle.

7. The method according to claim 6, wherein a compensation counter is increased for each residual turnable vehicle located at the origin approach.

8. The method according to claim 6, wherein a compensation counter is decreased by a difference between the number of the expected turnable vehicles and the number of the turned vehicles.

9. The method according to claim 5, wherein the turn directing signal group is a right turn signal group or a left turn signal group.

10. The method according to claim 1, wherein the received wireless identifying signals disregarded are known to have originated from the mobile communication device of the passenger of the common vehicle if a second wireless identifying signal received directly subsequent to a first wireless identifying signal has a value change of signal strength indication less than a predetermined motion threshold and said first identifying signal has a change of signal strength indication greater than said predetermined motion threshold.

11. The method according to claim 2, wherein the green light time is allocated by— a) compiling, for each signal group, a list of non-disregarded vehicle-specific signals waiting for green light time;

b) sequentially removing a respective non-disregarded vehicle-specific signal from the waiting list after a vehicle corresponding to the non-disregarded vehicle-specific signal crosses the intersection;

c) comparing, for each signal group, a determined number of non-disregarded vehicle-specific signals on the waiting list with a number of non-disregarded vehicle-specific signals that have crossed the intersection; and d) adjusting the allocated green light time if a difference between the determined number of non-disregarded vehicle-specific signals on the waiting list and the number of non-disregarded vehicle-specific signals that have crossed the intersection is greater than a predetermined range of values or if the total number of non-disregarded vehicle-specific signals waiting for green light is less than or equal to the total number of non-disregarded vehicle-specific signals that have crossed the intersection and the last non-disregarded vehicle-specific signal in the waiting list crossed the intersection at a predetermined time before the end of allocated green light time.

12. The method according to claim 11, wherein the adjusted green light time is corrected by considering maximum green light time or maximum red light time.

13. The method according to claim 12, wherein the waiting list is adjusted according to the adjusted green light time.

14. The method according to claim 1, wherein the wireless identifying signal is a short-range wireless identifying signal and the signal controller transceiver is a short-range transceiver.

15. The method according to claim 2, wherein a respective non-disregarded vehicle-specific signal of the respective non-disregarded vehicle-specific signals is attributed to the respective given signal group by measuring changes in a GPS derived location of the mobile communication device mounted on a corresponding vehicle and comparing said measured changes to a fifth predetermined threshold, whereby said corresponding vehicle is attributed to a red light signal group when said measured changes are less than said fifth predetermined threshold and is attributed to a green light signal group when said measured changes are greater than said fifth predetermined threshold.

16. The method according to claim 2, wherein a respective non-disregarded vehicle-specific signal of the respective non-disregarded vehicle-specific signals is attributed to the given signal group by obtaining data from one or more vehicular sensors and determining thereby an instantaneous travel direction of a corresponding vehicle.

17. A traffic light system, comprising:

a) a plurality of traffic lights for directing the passage of vehicles through an intersection;

b) a vehicle unit provided with a vehicle processing unit and a transceiver, for generating identifying signals; and c) a control unit mounted in a central region of said intersection, said control unit comprising a signal controller in communication with each of said plurality of traffic lights, a signal controller transceiver having a directional antenna for receiving the identifying signals from said vehicle unit, and a signal controller interface processing unit (SCIPU) in communication with said signal controller and with said signal controller transceiver, wherein said SCIPU is operable to— i. receive and disregard identifying signals that originated from a mobile device of passengers of a common vehicle or of pedestrians, while considering the received identifying signals from said vehicle unit as vehicle-specific signals if a value change of a signal strength indication of each of the received identifying signals is higher than a first predetermined threshold;

ii. disregard one of said vehicle-specific signals if said control unit determines that it originated downstream to said intersection, its value of signal strength indication decreases with time, or a difference between the values of signal strength indication received at two approaches of said intersection, respectively, is less than a second predetermined threshold;

iii. determine that a vehicle is located at a given approach of said intersection if the value of the signal strength indication of a corresponding non-disregarded vehicle-specific signal at said given approach is greater than a third predetermined threshold and is greater than the value of the signal strength indication of said corresponding non-disregarded vehicle-specific signal received at the other approaches of said intersection; and iv. count a real-time number of vehicles located on each of said one or more approaches based on the non-disregarded vehicle-specific signal and to allocate a duration of green light time for each of said plurality of traffic lights in response to the real-time number of vehicles located on a corresponding approach, wherein said signal controller is operable to control operation of said plurality of traffic lights associated with said intersection in accordance with said allocated green light time.

* * * * *